US012203694B2

(12) United States Patent
Ramirez et al.

(10) Patent No.: US 12,203,694 B2
(45) Date of Patent: Jan. 21, 2025

(54) THERMAL FRAME WITH FLANGE HEAT INPUT

(71) Applicant: Anthony, Inc., Sylmar, CA (US)

(72) Inventors: Juan Pablo Ramirez, Burbank, CA (US); Juan Francisco Flores, Valencia, CA (US)

(73) Assignee: Anthony, Inc., Sylmar (CA)

( * ) Notice: Subject to any disclaimer, the term of this patent is extended or adjusted under 35 U.S.C. 154(b) by 637 days.

(21) Appl. No.: 17/327,637

(22) Filed: May 21, 2021

(65) Prior Publication Data

US 2022/0373246 A1 Nov. 24, 2022

(51) Int. Cl.

*F25D 23/02* (2006.01)
*F25D 21/04* (2006.01)
*F25D 23/08* (2006.01)

(52) U.S. Cl.

CPC ..... *F25D 23/028* (2013.01); *F25D 21/04* (2013.01); *F25D 23/087* (2013.01); *F25D 2400/18* (2013.01); *F25D 2400/34* (2013.01)

(58) Field of Classification Search

CPC .... F25D 23/028; F25D 23/082; F25D 23/085; F25D 23/087; F25D 2400/18; F25D 2400/34; F25D 21/04

See application file for complete search history.

(56) References Cited

U.S. PATENT DOCUMENTS

| | | | | |
|---|---|---|---|---|
| 1,893,399 | A | 1/1933 | Gasket | |
| 2,591,003 | A | 4/1952 | Philipp | |
| 2,858,408 | A | 10/1958 | Barroero | |
| 3,167,821 | A | 2/1965 | Clark et al. | |
| 3,274,741 | A | 9/1966 | Neagle | |
| 3,697,723 | A * | 10/1972 | Winsler | F25D 23/02 219/218 |
| 3,882,637 | A | 5/1975 | Lindenschmidt | |
| 4,004,370 | A | 1/1977 | Heaney | |
| 4,150,518 | A | 4/1979 | Truesdell et al. | |
| 4,330,310 | A | 5/1982 | Tate, Jr. et al. | |
| 4,588,235 | A | 5/1986 | Barroero | |
| 4,741,127 | A | 5/1988 | Brockwinkel | |
| 4,831,780 | A | 5/1989 | Bockwinkel et al. | |
| 4,852,303 | A | 8/1989 | Rolek | |
| 4,858,386 | A | 8/1989 | Nail | |
| 4,891,912 | A | 1/1990 | Bockwinkel | |

(Continued)

FOREIGN PATENT DOCUMENTS

| | | |
|---|---|---|
| CN | 103189696 | 7/2013 |
| CN | 205561404 | 9/2016 |

(Continued)

OTHER PUBLICATIONS

Office Action in Canadian Appln. No. 3,159,623, dated Aug. 17, 2023, 4 pages.

(Continued)

*Primary Examiner* — Daniel J Rohrhoff
(74) *Attorney, Agent, or Firm* — Fish & Richardson P.C.

(57) ABSTRACT

A frame for a refrigerated enclosure includes a frame segment having, in cross-section, a main frame member including a base, a middle wall, and a forward flange. The forward flange of the main frame member absorbs heat from the ambient air to increase a temperature of one or more locations of the frame segment or a door of the refrigerated enclosure.

16 Claims, 16 Drawing Sheets

(56) References Cited

U.S. PATENT DOCUMENTS

| | | | | |
|---|---|---|---|---|
| 4,941,289 | A | 7/1990 | Rolek | |
| 4,948,206 | A * | 8/1990 | Fitzpatrick | A47F 3/043 312/405 |
| 4,998,382 | A | 3/1991 | Kostos et al. | |
| 5,024,023 | A * | 6/1991 | Kostos | E06B 3/5427 52/786.13 |
| 5,035,085 | A | 7/1991 | Mamelson et al. | |
| 5,111,618 | A | 5/1992 | Kaspar et al. | |
| 5,117,587 | A | 6/1992 | Doan | |
| 5,214,877 | A * | 6/1993 | Kaspar | F25D 17/047 49/70 |
| 5,255,473 | A | 10/1993 | Kasper | |
| 5,269,099 | A | 12/1993 | Kennedy et al. | |
| 5,645,330 | A | 7/1997 | Artwohl et al. | |
| 5,720,536 | A | 2/1998 | Jenkins et al. | |
| 5,992,960 | A | 11/1999 | Wolanin | |
| 6,029,411 | A | 2/2000 | Richardson | |
| 6,298,615 | B1 | 10/2001 | Richardson | |
| 6,350,002 | B1 | 2/2002 | Takaoka et al. | |
| 6,367,223 | B1 | 4/2002 | Richardson et al. | |
| 7,096,640 | B1 | 8/2006 | Chevian et al. | |
| 7,147,292 | B2 | 12/2006 | Lee et al. | |
| 7,207,181 | B2 | 4/2007 | Murray et al. | |
| 7,407,240 | B2 | 8/2008 | Collins et al. | |
| 8,070,305 | B2 | 12/2011 | Bratton | |
| 8,083,305 | B2 | 12/2011 | Lee et al. | |
| 8,801,116 | B1 | 8/2014 | Pack et al. | |
| 8,985,795 | B2 | 3/2015 | Thomas et al. | |
| 8,998,354 | B2 | 4/2015 | Wach et al. | |
| 9,157,675 | B2 | 10/2015 | Howington et al. | |
| 9,328,549 | B1 | 5/2016 | Alexander et al. | |
| 9,389,013 | B2 * | 7/2016 | Rolek | A47F 3/0426 |
| 9,417,006 | B2 | 8/2016 | Shen | |
| 10,045,638 | B2 | 8/2018 | Artwohl | |
| 10,178,917 | B2 | 1/2019 | Thoutam et al. | |
| 10,182,664 | B2 | 1/2019 | Chikkakalbalu et al. | |
| 10,365,029 | B2 * | 7/2019 | Grenier | E06B 1/325 |
| 10,390,632 | B2 | 8/2019 | Artwohl et al. | |
| 10,655,906 | B2 | 5/2020 | Okazaki et al. | |
| 10,898,011 | B2 | 1/2021 | Artwohl et al. | |
| 11,684,180 | B2 | 6/2023 | Gomez | |
| 11,832,740 | B2 | 12/2023 | Ramirez et al. | |
| 2001/0003408 | A1 | 6/2001 | Otto et al. | |
| 2005/0242529 | A1 | 11/2005 | Kim et al. | |
| 2006/0080995 | A1 | 4/2006 | An | |
| 2009/0007587 | A1 | 1/2009 | Lanzl et al. | |
| 2011/0011121 | A1 | 1/2011 | Kim | |
| 2011/0304253 | A1 | 12/2011 | Howington et al. | |
| 2013/0285517 | A1 | 10/2013 | Wach et al. | |
| 2014/0103791 | A1 | 4/2014 | Cheon | |
| 2014/0203699 | A1 | 7/2014 | Pack et al. | |
| 2015/0250332 | A1 | 9/2015 | Mille et al. | |
| 2015/0338153 | A1 | 11/2015 | Zhao et al. | |
| 2016/0047592 | A1 | 2/2016 | Rolek et al. | |
| 2018/0146798 | A1 | 5/2018 | Artwohl et al. | |
| 2018/0344054 | A1 | 12/2018 | Artwohl et al. | |
| 2019/0212051 | A1 | 7/2019 | Mayer et al. | |
| 2019/0335922 | A1 | 11/2019 | Artwohl et al. | |
| 2021/0059433 | A1 | 3/2021 | Lennon | |
| 2021/0227998 | A1 | 7/2021 | Artwohl et al. | |
| 2022/0369832 | A1 | 11/2022 | Gomez | |
| 2022/0369833 | A1 | 11/2022 | Ramirez et al. | |
| 2022/0372811 | A1 | 11/2022 | Gomez | |
| 2022/0373244 | A1 | 11/2022 | Powade et al. | |
| 2023/0086468 | A1 * | 3/2023 | Lanzl | F25D 21/04 |
| 2023/0301445 | A1 | 9/2023 | Gomez | |
| 2024/0081554 | A1 | 3/2024 | Ramirez et al. | |

FOREIGN PATENT DOCUMENTS

| | | |
|---|---|---|
| CN | 106500435 | 3/2017 |
| DE | 102009002800 | 11/2010 |
| DE | 102012223544 | 6/2014 |
| EP | 1801525 | 1/2012 |
| EP | 2908074 | 8/2015 |
| EP | 2985551 | 2/2016 |
| FR | 1314273 A | 1/1963 |
| GB | 335362 | 9/1930 |
| JP | 2002107078 | 4/2002 |
| WO | WO 2000/20719 | 4/2000 |
| WO | WO 2004083545 | 9/2004 |
| WO | 2008066542 A1 | 6/2008 |
| WO | WO 2010042186 | 4/2010 |
| WO | WO 2011076445 | 6/2011 |
| WO | WO 2013060417 | 5/2013 |
| WO | WO 2014030041 | 2/2014 |
| WO | WO 2015127996 | 9/2015 |
| WO | WO 2018097912 | 5/2018 |

OTHER PUBLICATIONS

Office Action in Canadian Appln. No. 3,159,636, dated Jul. 27, 2023, 4 pages.

Office Action in Canadian Appln. No. 3,159,638, dated Sep. 6, 2023, 7 pages.

Office Action in Canadian Appln. No. 3,159,643, dated Sep. 27, 2023, 6 pages.

Office Action in Canadian Appln. No. 3,159,647, dated Jul. 27, 2023, 4 pages.

CN Office Action in Chinese Application No. 201780080430.0, dated Feb. 3, 2020, 11 pages (with English translation).

EP Office Action in European Application No. 17 800 979.1, dated Mar. 13, 2019, 5 pages.

International Search Report and Written Opinion in International Application No. PCT/US2017/057512, dated Jan. 16, 2018, 14 pages.

* cited by examiner

THERMAL FRAME WITH FLANGE HEAT INPUT

TECHNICAL FIELD

This invention relates to temperature controlled storage devices, and doors and associated frames used in such devices.

BACKGROUND

Refrigerated enclosures are used in commercial, institutional, and residential applications for storing and/or displaying refrigerated or frozen objects. Refrigerated enclosures may be maintained at temperatures above freezing (e.g., a refrigerator) or at temperatures below freezing (e.g., a freezer). Refrigerated enclosures have one or more doors or windows for accessing and viewing refrigerated or frozen objects within a temperature-controlled space. Refrigerated enclosures typically include a frame that supports the doors or windows.

Condensation on sealing surfaces of doors of refrigerated enclosures and their associated frames can impair sealing and decrease energy efficiency. Formation of condensation (frost formation) on door also affects visibility to product placed inside enclosure and may cause customer dissatisfaction. Electric heater wires are sometimes employed in the thermal frames of commercial refrigerated enclosures to inhibit condensation. However, electrical heaters can use a significant amount of electrical power. Excess reliance on such heater wires may make ever more stringent government regulations on energy efficiency more difficult to meet.

SUMMARY

One aspect of the invention features a temperature-controlled enclosure for displaying cold items. The temperature-controlled enclosure includes a body, a frame assembly, and one or more doors. The body includes a front opening and defines an interior space of the enclosure. The frame assembly is coupled in the front opening of the body. The frame assembly includes a frame segment having, in cross-section, a main frame member and a contact plate. The main frame member has a base, a middle wall, and a forward flange. The door(s) has one or more window panels and a gasket coupled on the rear surface of the door. The gasket forms a seal between the frame assembly and the door when the door is closed. One or more physical characteristic(s) of the forward flange are selected to control one or more thermal characteristic(s) at one or more locations on the frame assembly or the door(s).

In some implementations, the selected physical characteristic(s) of the forward flange includes a length of the forward flange.

In some implementations, the length of the forward flange inhibits condensation at one more locations on the contact plate.

In some implementations, the selected physical characteristic(s) of the forward flange includes a front surface area of the forward flange.

In some implementations, the thermal characteristic(s) includes a temperature at one or more locations.

In some implementations, the thermal characteristic(s) includes a temperature at one or more locations on the contact plate.

In some implementations, the thermal characteristic(s) includes a temperature at an outer edge of at least one of the doors.

In some implementations, one of the physical characteristic(s) of the forward flange is selected to maintain a temperature of at least one of the locations above the dew point of ambient air surrounding the refrigerated enclosure.

In some implementations, one of the physical characteristic(s) of the forward flange is selected to maintain a temperature at one or more locations on the contact plate at or above a selected temperature.

In some implementations, one of the physical characteristic(s) of the forward flange is selected to inhibit condensation at one or more locations on the frame assembly or the doors.

In some implementations, the frame segment includes a backing member and a contact plate. The backing member and contact plate are coupled to the main frame member. The backing member includes a rear leg that couples on the rear wall of the base of the main frame member, and an interior leg that couples on the interior wall of the base of the main frame member. The interior leg and the rear leg each include a thermal insulating portion, and a contact plate coupled to the main frame member.

In some implementations, the interior leg further includes a front portion that couples with the contact plate.

In some implementations, the interior leg further includes a front portion that couples with the contact plate.

In some implementations, the temperature-controlled enclosure includes an insulating member between the forward flange and the body of the refrigerated enclosure.

Another aspect of the invention features a frame for a refrigerated enclosure includes a frame segment having, in cross-section, a main frame member including a base, a middle wall, and a forward flange. The forward flange of the main frame member absorbs heat from the ambient air to increase a temperature of one or more locations of the frame segment. The forward flange has a length of at least about 1.5 inches.

In some implementations, the forward flange includes a curved front surface.

In some implementations, the forward flange includes a front surface having two or more grooves or ridges.

In some implementations, the forward flange includes a rear surface having two or more grooves or ridges.

In some implementations, the forward flange has a length of about 1.6 inches.

In some implementations, the forward flange of the main frame member that, during use, absorbs heat from ambient air to maintain one or more thermal characteristic(s) at one more locations of the frame segment in a target range.

Another aspect of the invention features a method of controlling condensation on a refrigerated enclosure that includes: selecting one or more target thermal characteristics at one or more locations of a door/frame interface of a refrigerated enclosure; and providing a thermal frame with a forward flange having one or more physical characteristics that maintain the at least one of the target characteristics.

In some implementations, the physical characteristic(s) include a length of the forward flange.

In some implementations, the forward flange includes a length of at least about 1.5 inches.

In some implementations, the method includes increasing a length of the forward flange.

The concepts described herein may provide several advantages. For example, implementations of the invention may provide a frame with improved thermal efficiency.

Implementations may prevent or minimize condensation build up on door sealing surfaces. Implementations may provide for a more positive thermal seal between a thermal frame and a door.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

In some implementations, a frame segment assembly includes an L-shaped backing member that fits on the back and interior faces of an inner member of the frame. The backing member includes a thermally insulating member for reducing thermal transference between the frame and the interior space of the enclosure. The insulating member can be an L-shape. In some implementations, the interior leg of the L-shaped backing member runs from the back of the frame to a rear surface of the door gasket. The contact plate of the frame can extend over the interior leg of the backing member.

Figure 1:
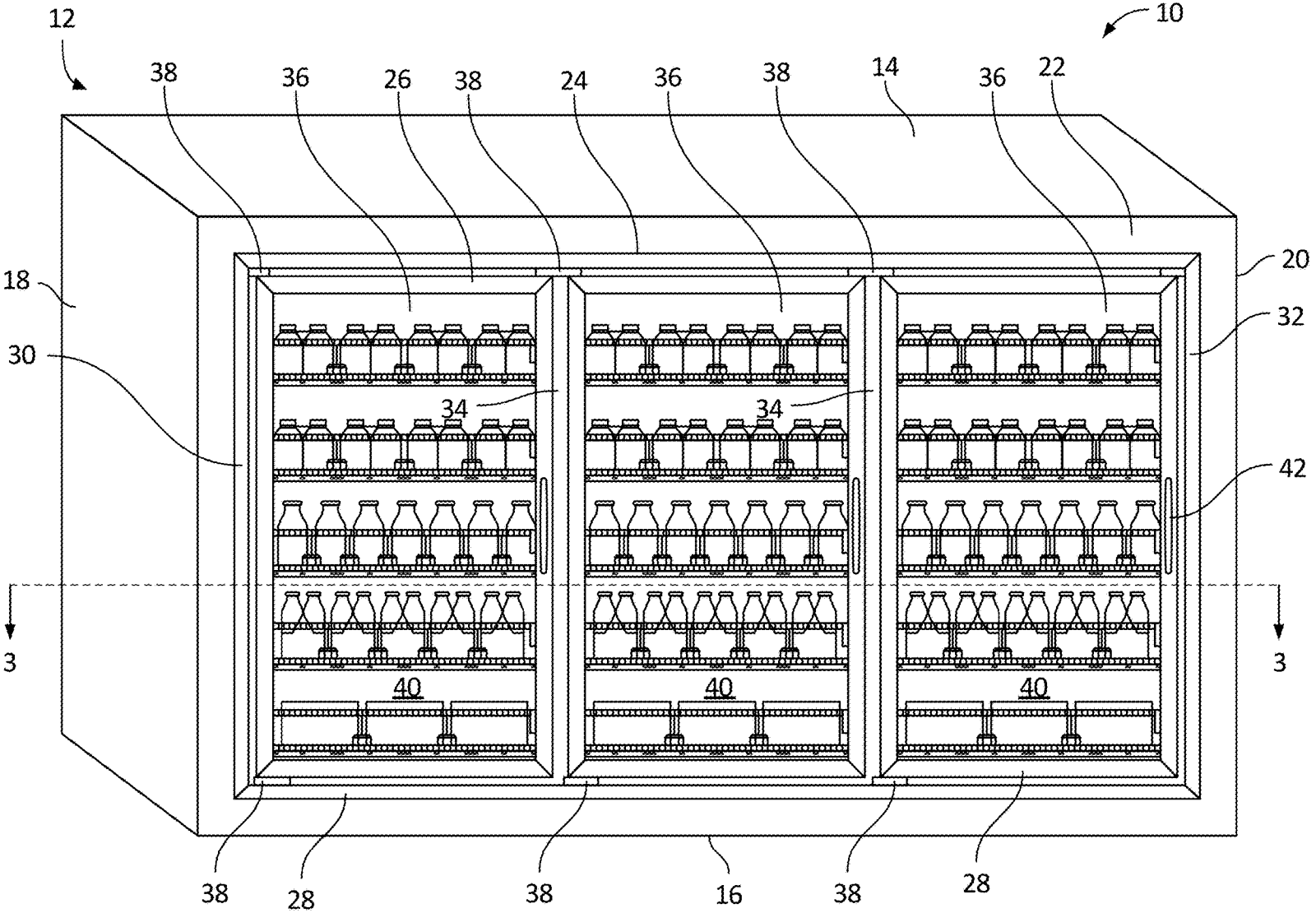
FIG. 1 is a perspective view of a refrigerated enclosure having multiple doors supported by a frame.
Figure 2:
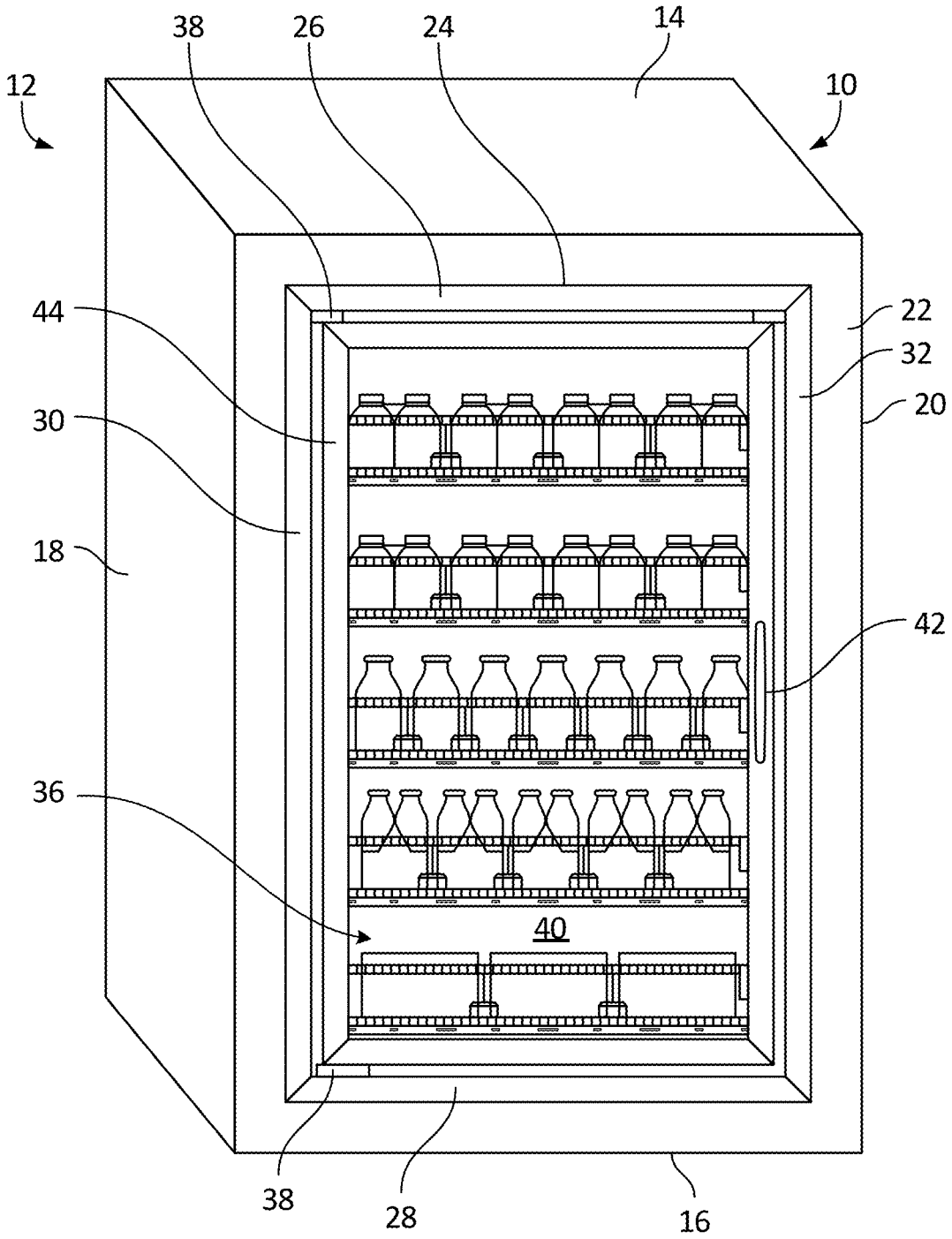
FIG. 2 is a perspective view of a refrigerated enclosure having a single door supported by a frame.

FIGS. 1-2 show an exemplary refrigerated enclosure 10. Refrigerated enclosure 10 may be a refrigerator, freezer, or other enclosure defining a temperature-controlled space. In some implementations, refrigerated enclosure 10 is a refrigerated display case. For example, refrigerated enclosure 10 may be a refrigerated display case or refrigerated merchandiser in grocery stores, supermarkets, convenience stores, florist shops, and/or other commercial settings to store and display temperature-sensitive consumer goods (e.g., food products and the like). Refrigerated enclosure 10 can be used to display products that must be stored at relatively low temperatures and can include shelves, glass doors, and/or glass walls to permit viewing of the products supported by the shelves. In some implementations, refrigerated enclosure 10 is a refrigerated storage unit used, for example, in warehouses, restaurants, and lounges. Refrigerated enclosure 10 can be a free standing unit or "built in" unit that forms a part of the building in which refrigerated enclosure 10 is located.

Refrigerated enclosure 10 includes a body 12. Body 12 includes a top wall 14, a bottom wall 16, a left side wall 18, a right side wall 20, a rear wall (not shown), and a front portion 22 defining a temperature-controlled space. Front portion 22 includes an opening into the temperature-controlled space. Thermal frame 24 is can be mounted at least partially within the opening. Thermal frame 24 includes a plurality of perimeter frame segments (i.e., a header or top frame segment 26, a sill or bottom frame segment 28, a left side frame segment 30, and a right side frame segment 32) forming a closed shape along a perimeter of the opening. In some implementations, thermal frame 24 includes one or more mullion frame segments 34 dividing the opening into multiple smaller openings. For example, FIG. 1 illustrates a three-door assembly with a pair of mullion frame segments 34 extending between top frame segment 26 and bottom frame segment 28 to divide the opening into three smaller openings. Each of the smaller openings may correspond to a separate door 36 of the three-door assembly. In other implementations, mullion frame segments 34 may be omitted. For example, FIG. 2 illustrates a one-door assembly wherein thermal frame 24 includes perimeter frame segments 26-32 but not mullion frame segments 34. In some implementations, thermal frame 24 includes include top frame segment 26 and bottom frame segment 28 with no side frame segments 30 or 32. In such implementation, thermal frame 24 may include one or more mullion frame segments 34 depending, for example, on the size of the refrigerated enclosure in which thermal frame 204 is to be installed and the number of doors.

Refrigerated enclosure 10 includes one or more doors 36 pivotally mounted on the thermal frame 24 by hinges 38. In some implementations, the doors 36 are sliding doors configured to open and close by sliding relative to the thermal frame 24. The example doors 36 illustrated in FIGS. I and 2 include panel assemblies 40 and handles 42. Referring to FIG. 2, thermal frame 24 is includes a series of contact plates 44. Contact plates 44 are he attached to a front surface of thermal frame 24 and provide a sealing surface against which doors 36 rest in the closed position. For example, doors 36 may include a gasket or other sealing feature around a perimeter of each door 36. The gaskets may employ a flexible bellows and magnet arrangement, which, when the doors 36 are closed, engage contact plates 44 to provide a seal between doors 36 and thermal frame 24. The thermal frames provide a thermally conductive path from the frame segments 26-32, for maintaining maintains the temperature of the contact plates 44 at or close to the temperature of the external environment (e.g., the environment outside of the refrigerated enclosure 10) and to aid in preventing condensation from forming on the contact plates 44. Preventing condensation on the contact plates may provide for a more positive seal between the contact plates 44 and a magnetic gasket on the door, thereby improving the thermal properties of the refrigerated enclosure 10.

Figure 3:
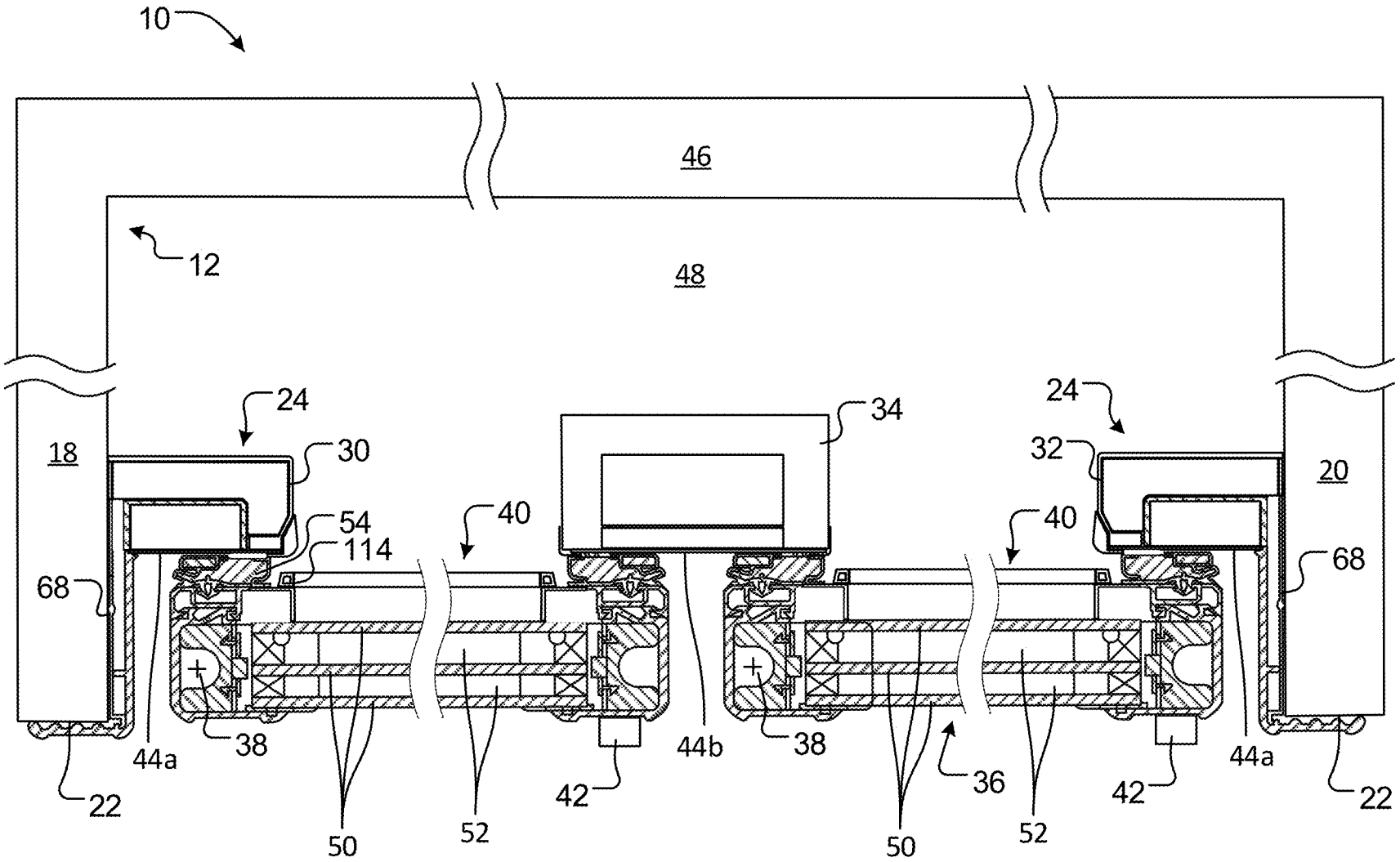
FIG. 3 is a cross-sectional view showing an example refrigerated enclosure with two doors and a mullion according to implementations of the present disclosure.

FIG. 3 illustrates a cross-sectional view of the refrigerated enclosure 10 taken along the line 3-3 in FIG. 1. FIG. 3 illustrates the pair of side walls 18 and 20 of the refrigerated enclosure 10 extending rearward from front portion 22, and a rear wall 46 extending between side walls 18 and 20 to define a temperature-controlled space 48 within the body 12.

In FIG. 3, refrigerated enclosure 10 is shown as a two-door assembly with a pair of doors 36 positioned in an opening in front portion 22. Refrigerated enclosure 10 may have two doors 36 (as shown in FIG. 3), a lesser number of doors 36 (e.g., a single door as shown in FIG. 2), or a greater number of doors 36 (e.g., three or more doors as shown in FIG. 1). Each door 36 includes a. panel assembly 40 and a handle 42. Applying a force to handle 42 causes the corresponding door 36 to rotate about hinges 38 between an open position and a closed position. In some implementations, panel assembly 40 is a transparent or translucent panel assembly through which items within temperature-controlled space 48 can be viewed when doors 36 are in the closed position. For example, panel assembly 40 is shown to include a plurality of transparent or translucent panels 50 with spaces 52 therebetween. The spaces 52 can be sealed and filled with an insulating gas (e.g., argon) or evacuated to produce a vacuum between panels 50. In some embodiments, panel assembly 40 includes opaque panels with an insulating foam or other insulator therebetween. Doors 36 include gaskets 54 attached to a rear surface of doors 36 along an outer perimeter of each door. Gaskets 54 are configured to engage a sealing surface of the contact plates 44*a* and 44*b* (referred to collectively as contact plates 44) when the doors 36 are in the closed position, and to thereby provide a seal between doors 36 and contact plates 44.

The perimeter frame segments 30-32 of the thermal frame 24 are coupled to the body 12 of the refrigerated enclosure 10 by mounting brackets 68. Mounting brackets 68 can be secured to perimeter frame segments 30-32 using one or more connection features (e.g., flanges, notches, grooves, collars, lips, etc.) or fasteners (e.g., bolts, screws, clips, etc.) and may hold perimeter frame segments 30-32 in a fixed position relative to the body 12 of the refrigerated enclosure 10.

Although only two perimeter frame segments 30-32 are shown in FIG. 3, other perimeter frame segments (e.g., header/top frame segment 26 and sill/bottom frame segment 28) may be configured in a similar manner. For example, top frame segment 26 and bottom frame segment 28 may be coupled to the body 12 of the refrigerated enclosure 10 by mounting brackets 68.

The perimeter frame segment assembly includes a perimeter frame segment (i.e., one of frame segments 26-32), a mounting bracket 68, and a contact plate 44.

One or more mullion frame segments 34 extend vertically between top frame segment 26 and bottom frame segment 28. A top portion of mullion frame segment 34 is fastened to a top frame segment 26 and a bottom portion of mullion frame segment 34 is fastened to a bottom frame segment 28.

In some implementations, the frame assembly includes an L-shaped thermally insulating backing member that fits on the back and interior faces of the main frame member of a mounting frame for the door of a commercial refrigerated enclosure. The backing member includes insulation for reducing thermal transference between the frame and the interior space of the enclosure. The interior leg of the L-shaped backing member may run from the back of the frame to the trailing edge of the door gasket. The contact plate of the frame can extend an interior direction over the interior leg of the backing member.

Figure 4:
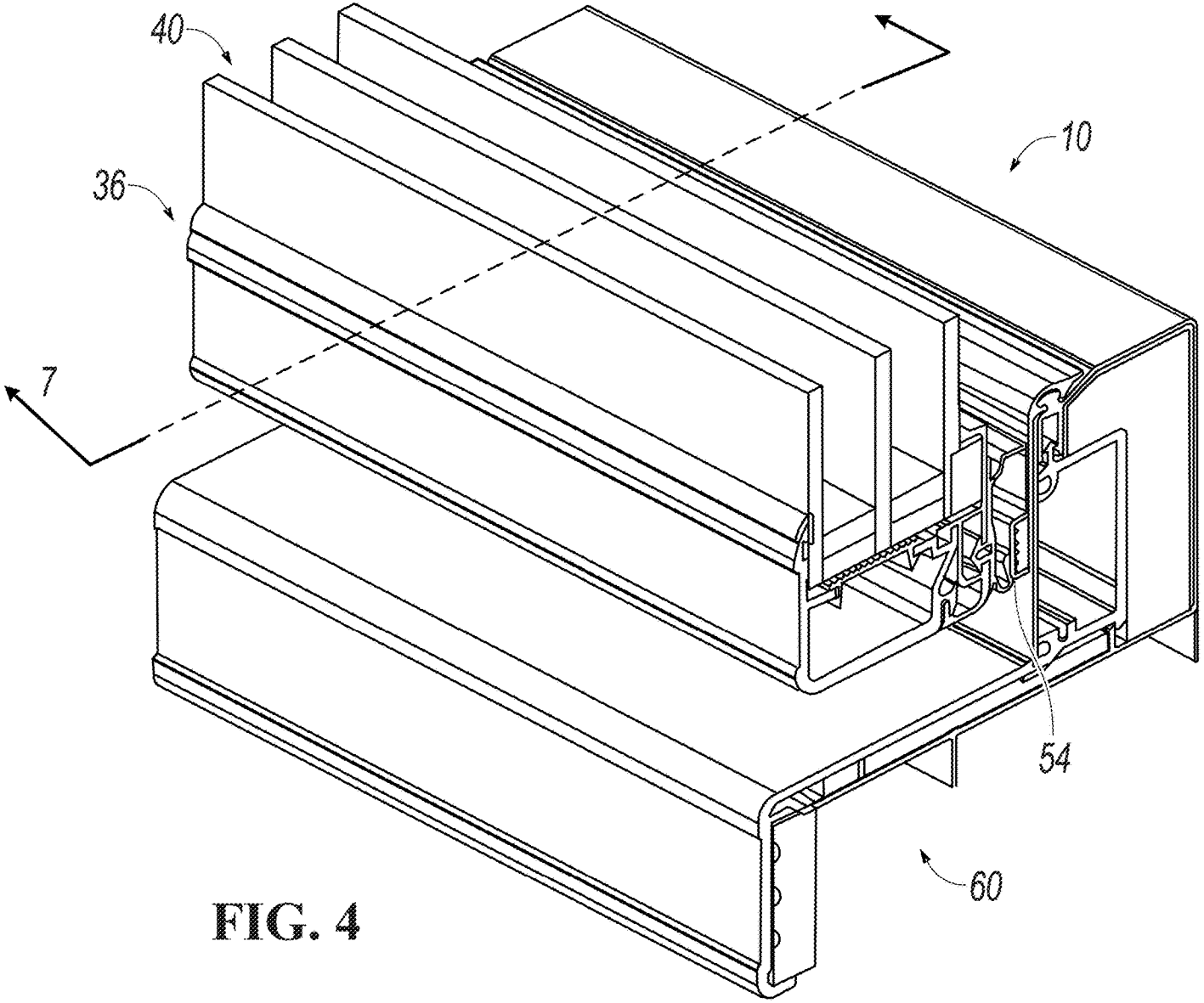
FIG. 4 illustrates refrigerated enclosure with a door in a closed position on a frame assembly according to implementations of the present disclosure.

FIG. 4 illustrates refrigerated enclosure with a door in a closed position on a frame assembly according to implementations of the present disclosure. Refrigerated enclosure 10 includes door 36 and frame segment assembly 60. Door 36 is closed on frame segment assembly 60. For illustrative purposes, only a short segment of the door and a corresponding segment of frame segment assembly shown. Nevertheless, the cross section shown in FIG. 4 can continue around the entire perimeter of window panel assemblies 40 and the corresponding perimeter of the frame assembly.

Door 36 includes window panel assembly 40 and gasket 54. Gasket 54 may run continuously around the perimeter of door 36. In various implementations, gasket 54 can be a single continuous piece, or can include a set of gasket components, with one gasket component on each of the edges of the perimeter. Gasket 54 can be made of a resilient material, such as synthetic rubber.

Figure 5:
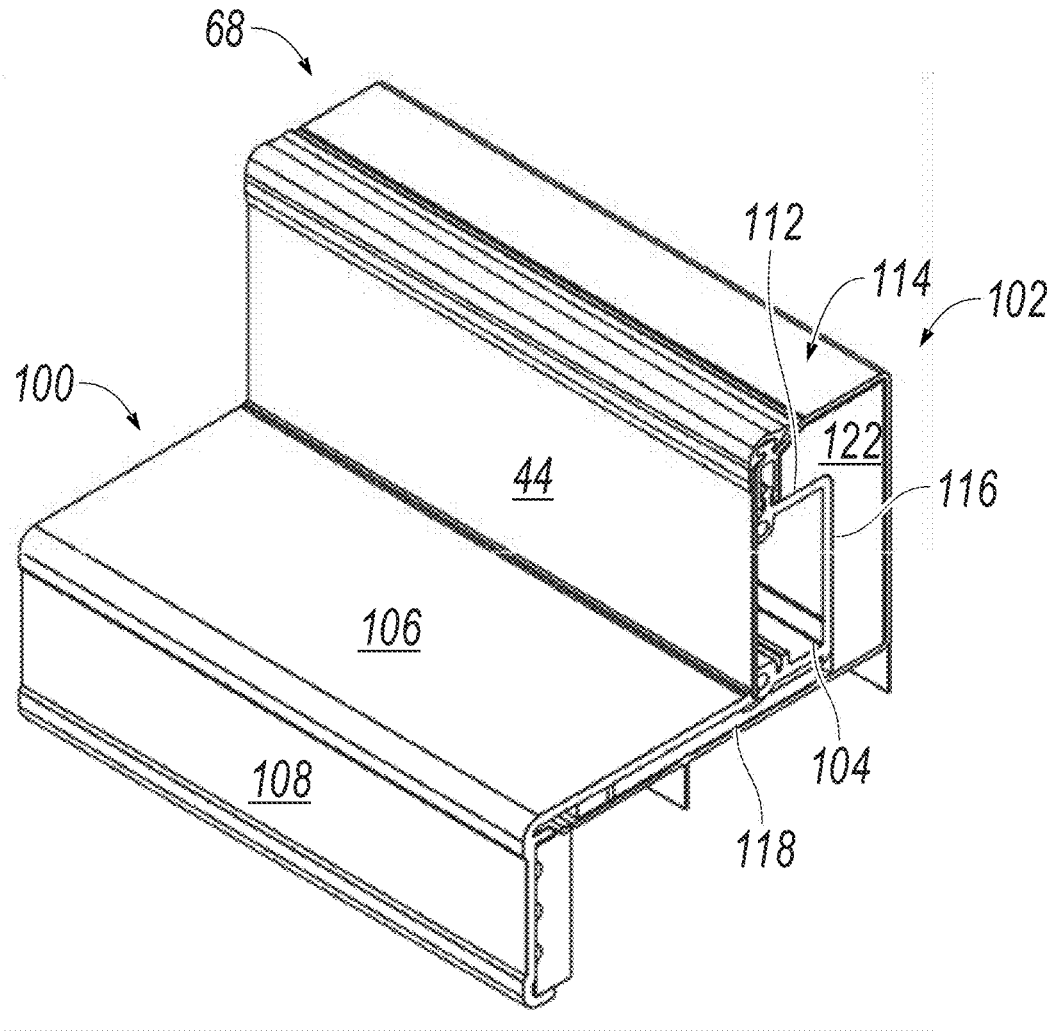
FIG. 5 is a perspective view of a frame segment assembly according to an illustrative implementation.

FIG. 5 is a perspective view of a frame segment assembly according to an illustrative implementation. Frame segment assembly 60 includes main frame member 100, backing member 102, and contact plate 44. Main frame member 100 includes base 104, middle wall 106, and forward flange 108.

Backing member 102 is coupled to main frame member 100. Interior leg 110 of backing member 102 is against interior wall 112 of main frame member 100. Rear leg 114 of backing member 102 is against rear wall 116 of main frame member 100. Exterior wall 118 of bracket 68 may run along an outer side wall 120 of base 104 and middle wall 106.

Backing member 102 includes bracket 68 and insulating member 122. In the implementation shown in FIG. 5, insulating member 122 has an L-shape with one leg of the insulating member forming part of rear leg 110 of backing member 102, and another leg of the insulating member forming a part of interior leg 110. Over a portion of exterior wall 118, insulating member 122 is disposed between exterior wall 118 of bracket 68 and the middle wall 106 of main frame member 100.

In some implementations, the interior leg of an insulating member extends all the way to a contact plate or gasket. In some implementations, the interior leg of insulating member extends more than half way from the rear edge of base 104 to the contact plate or more than half way from the rear edge of base 104 to rear surface of the gasket. In one implementation, a rear leg extends all the way across the rear surface of base 104. In one implementation, a rear leg extends more than half way across the rear surface abase 104. In some implementations, a rear leg extends all the way to a bracket in contact with the body of a refrigerated enclosure.

Figure 6:
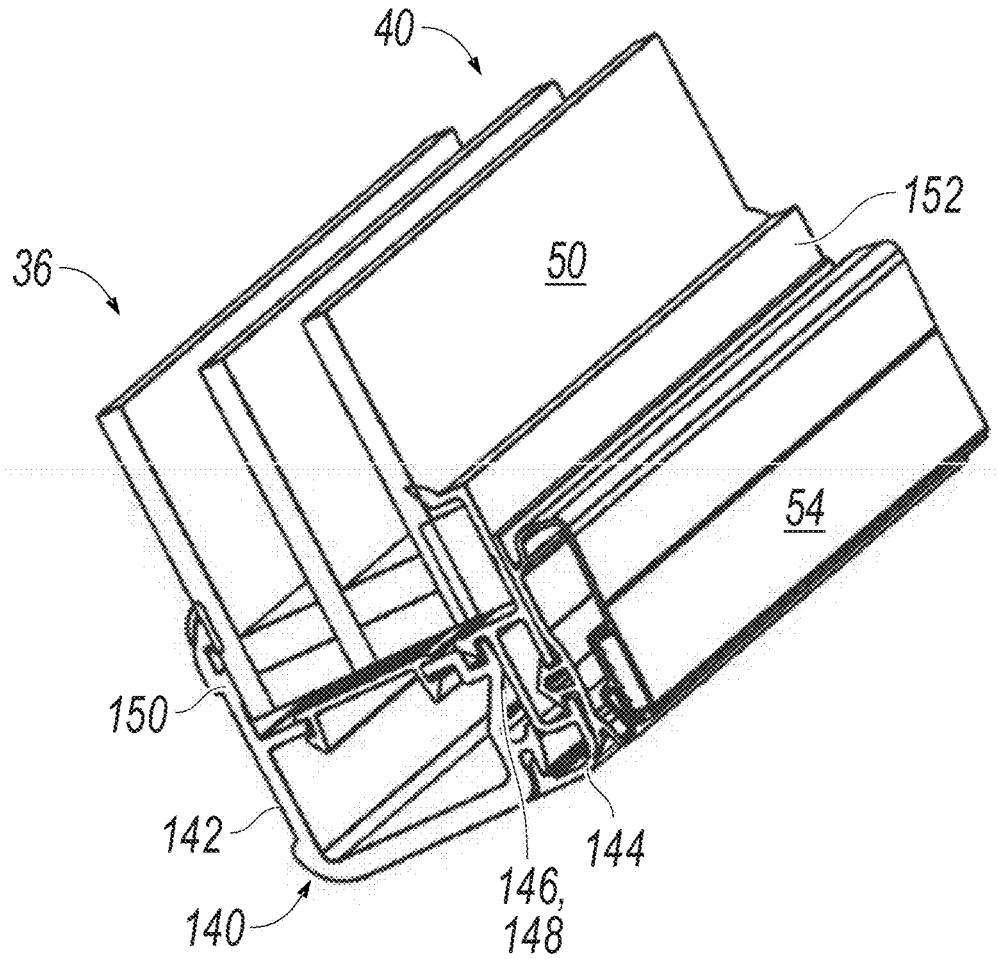
FIG. 6 is a perspective view of a door according to an illustrative implementation.

FIG. 6 is a perspective view of a door according to an illustrative implementation. Window panel assembly 40 includes panels 50 and housing assembly 140. Housing assembly 100 surrounds and supports the edges of window panels 50. Housing assembly 140 includes outer housing member 142 and rear retaining member 144. Rear retaining member 144 can snap together with outer housing member 142 by way of complementary engaging portions 146, 148. Window panels 50 are stacked between front retaining rim 150 of outer housing member 142 and rear retaining rim 152 of rear retaining member 144.

Figure 7:
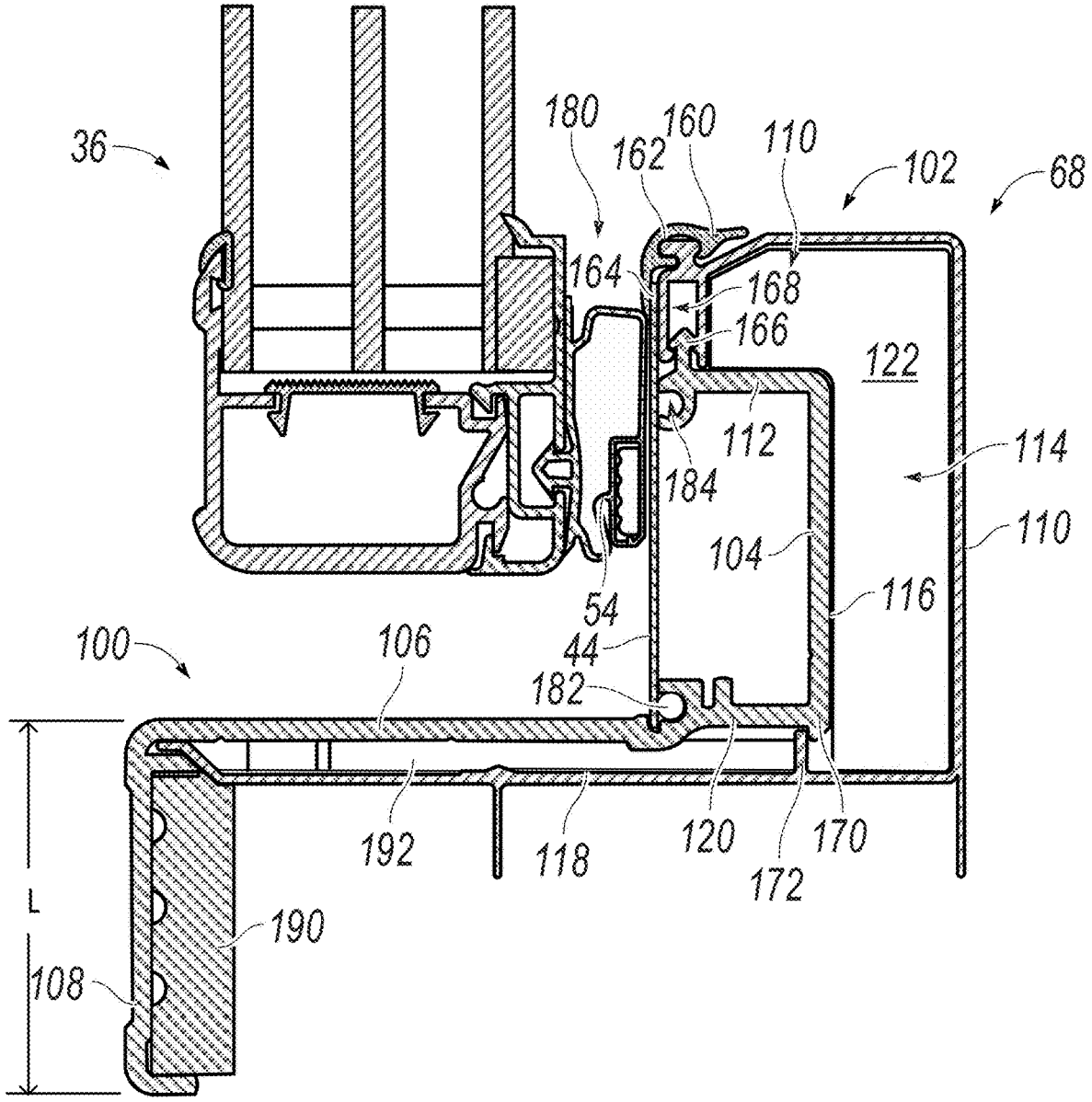
FIG. 7 is a cross-sectional view of a door in a closed position on a frame assembly according to an illustrative implementation.

FIG. 7 is a cross-sectional view of a door in a closed position on a frame assembly according to an illustrative implementation. The outer end of contact plate 44 is supported by main frame member 100. Contact plate 44 may be secured in place with a retaining clip 160 (e.g., a zipper strip or other suitable fastening device). Retaining clip 160 may be coupled to bracket 68 by an engagement feature 162 (e.g., a flange, a notch, a lip, a collar, a groove, etc.) of bracket 68 of backing member 102.

In the example shown in FIG. 7, bracket 68 extends to the plane of the front of base 104 of main frame member 100. Front surface 164 of bracket 68 contacts the rear surface of contact plate 44. Bracket 68 is secured to the interior side of base 100 of main frame member 100 by way of engagement of projection 166 of base 104 in retaining groove 168 of bracket 68.

In this implementation, insulating member 122, the front portion of bracket 68, and contact plate 44 form a continuous thennal barrier between temperature controlled space 48 of the refrigerated enclosure and main frame member 100. Retaining groove 168 can be deeper than the length of projection 166, such that an air pocket is defined inside the groove when the backing member 102 is coupled with main frame member 100.

On the exterior side of main frame member 100, projecting rim 170 of base 102 can engage with rib 172 on exterior wall 118 of bracket 68. In some cases, main frame member 100 and backing member 102 can be snapped into engagement with one another.

As assembled, contact plate 44 extends in an interior direction over a portion of backing member 102.

With door 36 closed on frame segment 60, a channel 180 is defined by the rear surface of door 36, a front surface of the frame segment 60, and an interior surface of gasket 54.

In some implementations, a main frame member includes heater wire channels that position the heater wire in direct contact with the contact plate of the frame.

In the example shown in FIG. 7, heater wires 182 are received in channels 184 formed in base 104 of main frame member 100. Channels 184 are open to the front of base 100 such that heater wires 182 can be in direct contact with contact plate 44.

In the implementation shown in FIG. 7, contact plate 44 is sandwiched between front surface 164 of backing member 102 and a rear surface of gasket 54. In other implementations, a backing member can be in direct contact with a door gasket when the door is closed.

In certain implementations, a portion of a backing member can project forward such that backing member overlaps the rear edge of the gasket. For example, in an alternate implementation, a portion of backing member 102 can extend into the region of channel 180.

Insulating member 190 is interposed between forward flange 108 of main frame member 100 and body 12 of the refrigerated enclosure 10. Insulating member 190 can be, in one example, seal tape. Insulating member 192 is interposed between exterior wall 118 of bracket 68 and middle wall 106 of main frame member 100. Insulating member 192 can be, in one example, a foam gasket. Insulating members 190 and 192 may thermally insulate main frame member 100 from body 12 and help maintain. contact plate 44 and door 36 at temperatures that inhibit condensation on contact plate 44 and surfaces of door 36.

Figure 8:
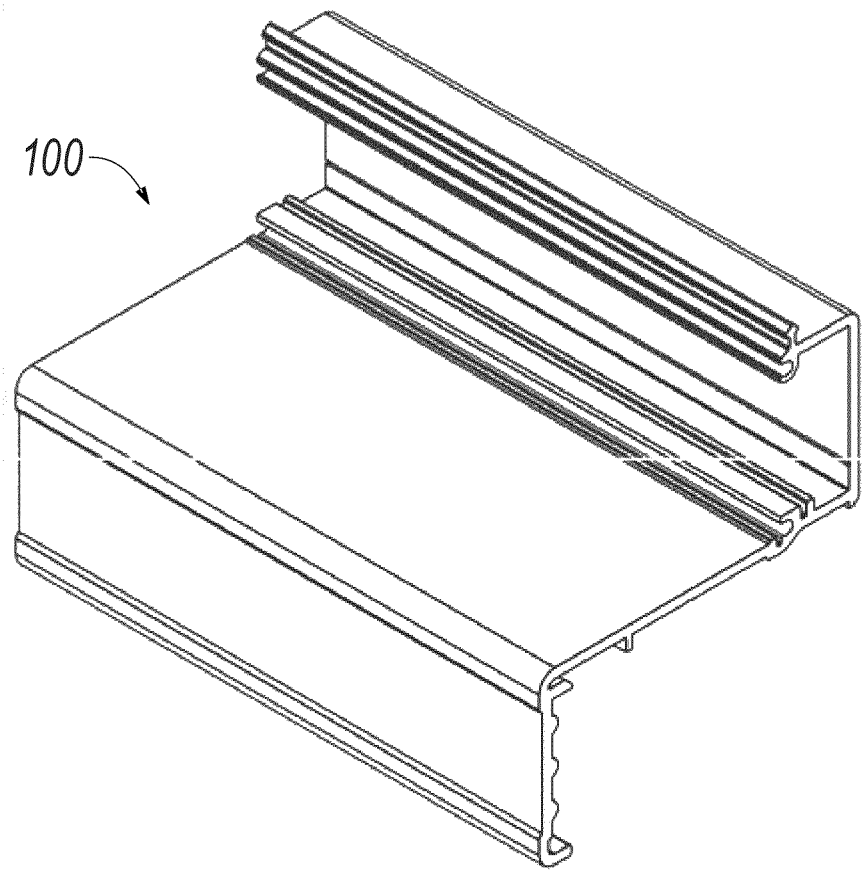
FIG. 8 depicts an example of a main frame member according to an illustrative implementation.

FIG. 8 depicts an example of a main frame member according to an illustrative implementation. Main frame member 100 can be, in some implementations, made of aluminum.

Figure 9:
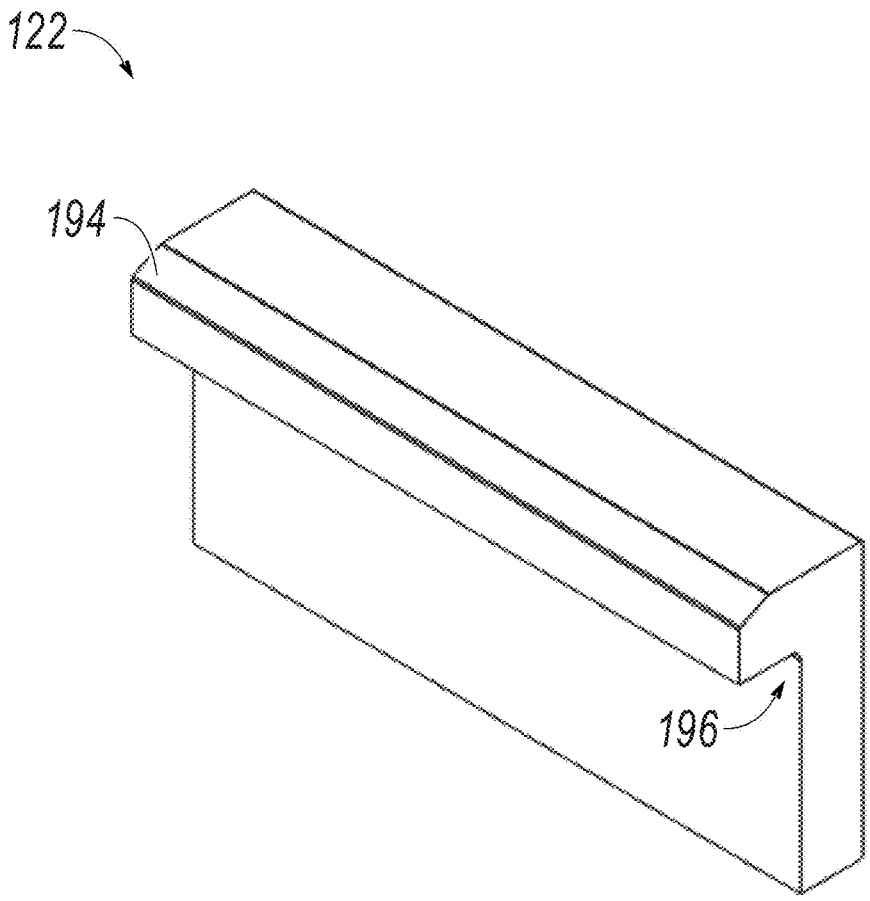
FIG. 9 depicts an example of an insulating member according to an illustrative implementation.

FIG. 9 depicts an example of an insulating member according to an illustrative implementation. In this example, insulating member 122 generally has an L-shape. Some surfaces of insulating member 122 can be sloped or contoured. For example, in the implementation shown in FIG. 9, insulating member 122 includes chamfer 194 and fillet 196. Insulating member 122 can be, in some implementations, made of an extruded polystyrene foam material such as Blue Board produced by Dow Chemical Company. In certain implementations, insulating member 122 can he made of a cellular PVC foam material. In some implementations, insulating material can be a Celuka material. In some implementations, insulating member 122 can be made of polystyrene. In certain implementations, an insulating member can include a vacuum insulated panel. Other thermally insulating materials can be used in various implementations.

Figure 10:
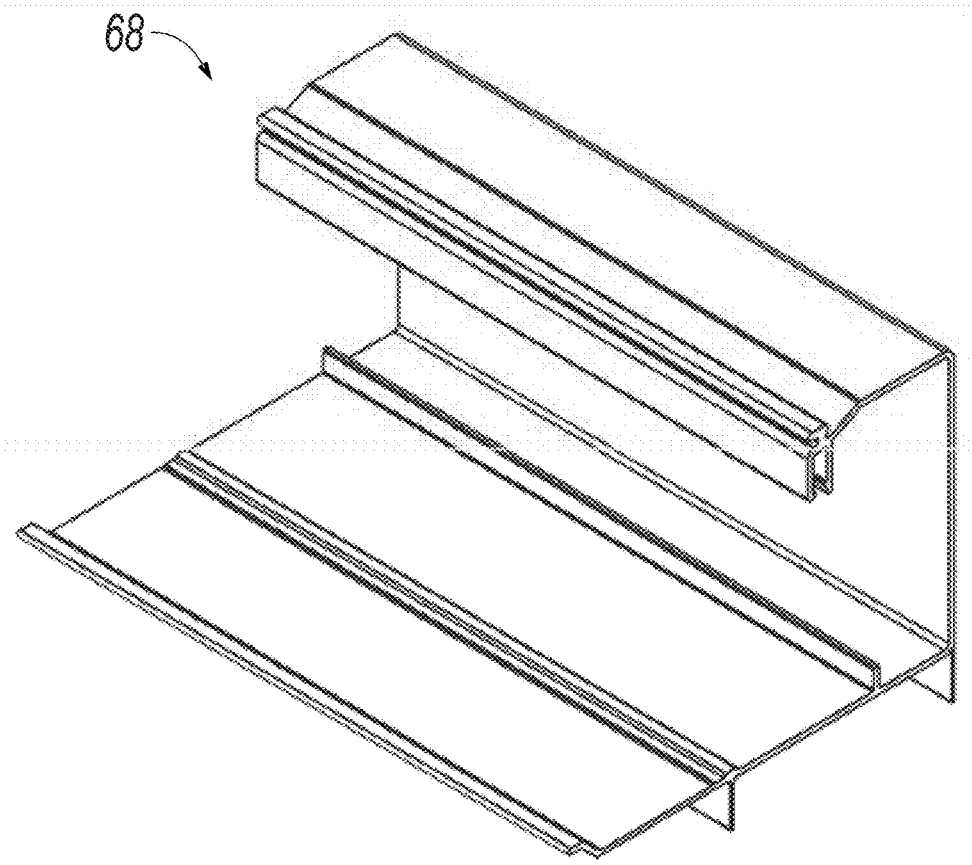
FIG. 10 depicts an example of a bracket of a backing member according to an illustrative implementation.

FIG. 10 depicts an example of a bracket of a backing member according to an illustrative implementation. Bracket 68 can be, in some implementations, made of a polystyrene.

Figure 11:
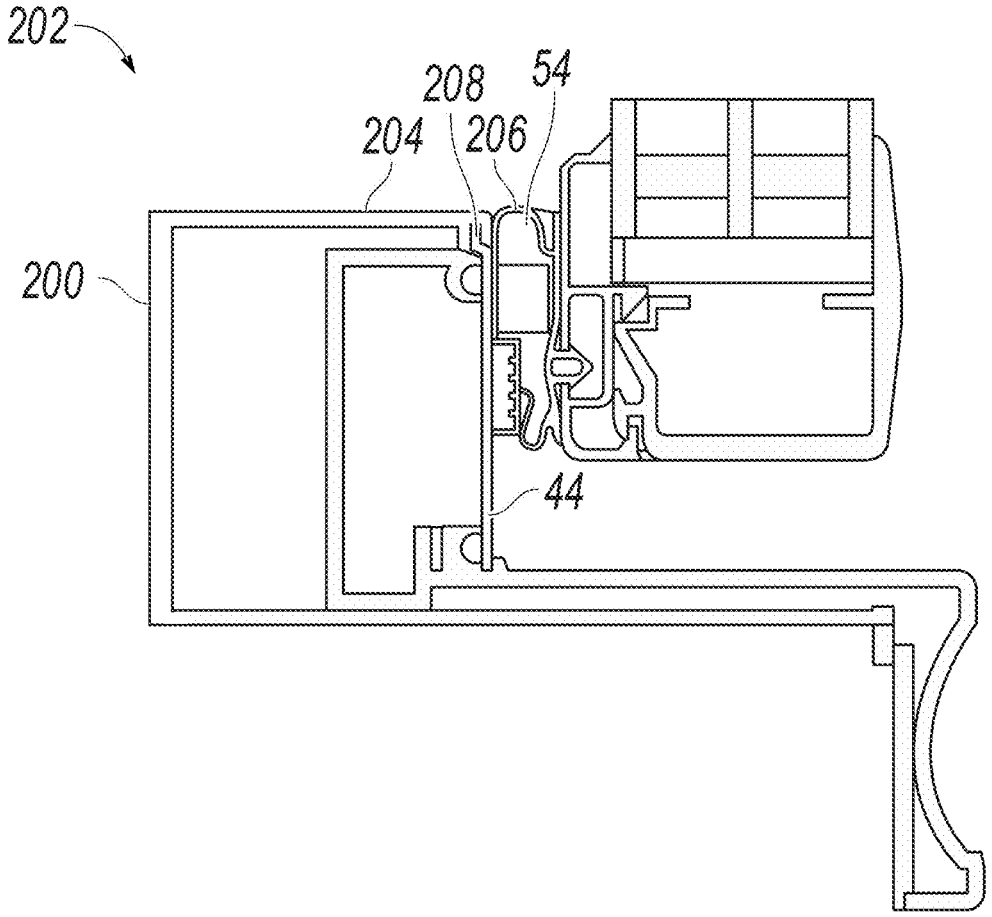
FIG. 11 depicts an example of a frame segment including a backing member that is in direct contact with a door gasket.

In some implementations, a backing member for a main frame segment wraps around the main frame member such as to be in direct contact with a door gasket. FIG. 11 depicts an example of a frame segment including a backing member that is in direct contact with a door gasket. In this example, the front portion of bracket 200 of backing member 202 captures and retains the interior edge of contact plate 44. The front edge of bracket 200 is coplanar with the front surface of contact plate 44 and contacts the rear surface of gasket 54. In the example shown in FIG. 11, the interior face 204 of backing member 202 is generally aligned with an interior surface 206 of gasket 54. The interior edge of contact plate 44 includes tab 208. Tab 208 is offset to the rear of the front surface of contact plate 44.

Figure 12:
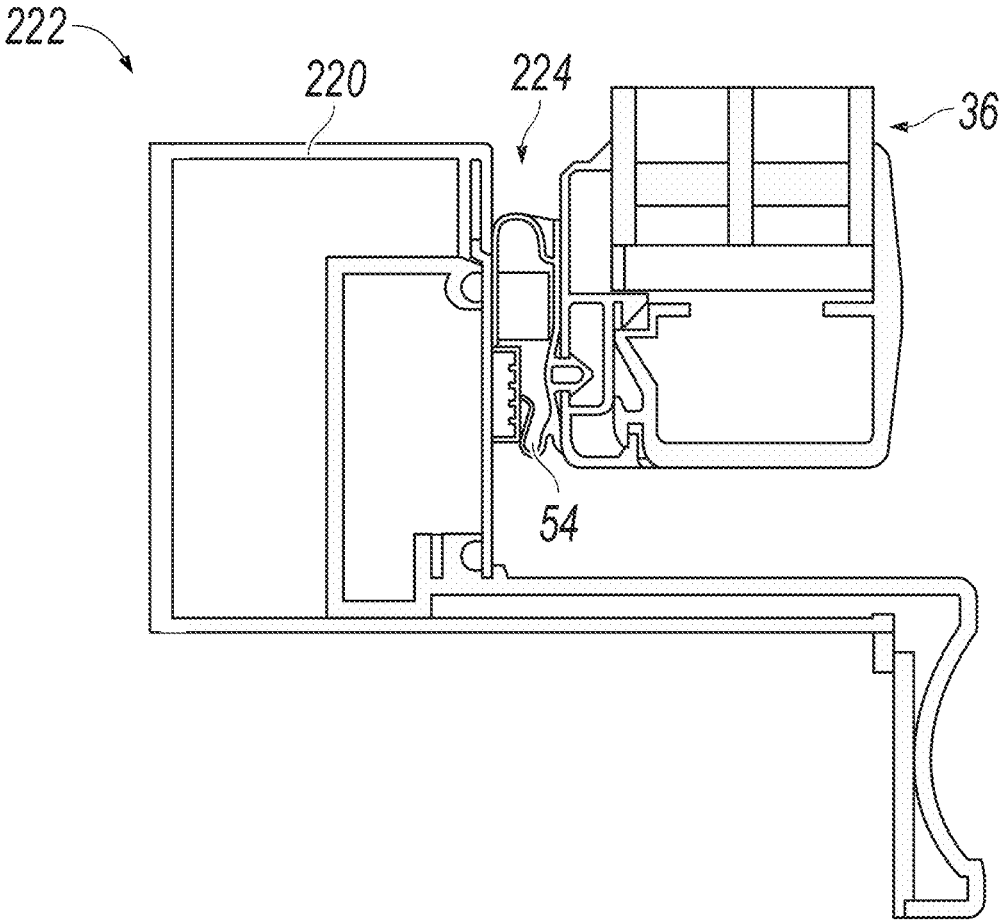
FIG. 12 depicts another example of a frame segment assembly including a backing member.

In some implementations, the interior edge of a backing member for a frame segment projects inwardly beyond the interior edge of a door gasket. FIG. 12 depicts another example of a frame segment assembly including a backing member. Inner surface 220 of backing member 222 is interior to the inner surface of gasket 54. A portion of the front edge of backing member 222 and a portion of rear surface of door 36 define a channel 224 between the interior surface of gasket 54 and the temperature controlled space. In one implementation, backing member 222 projects at least about 10 millimeters from the interior surface of gasket 54.

Figure 13:
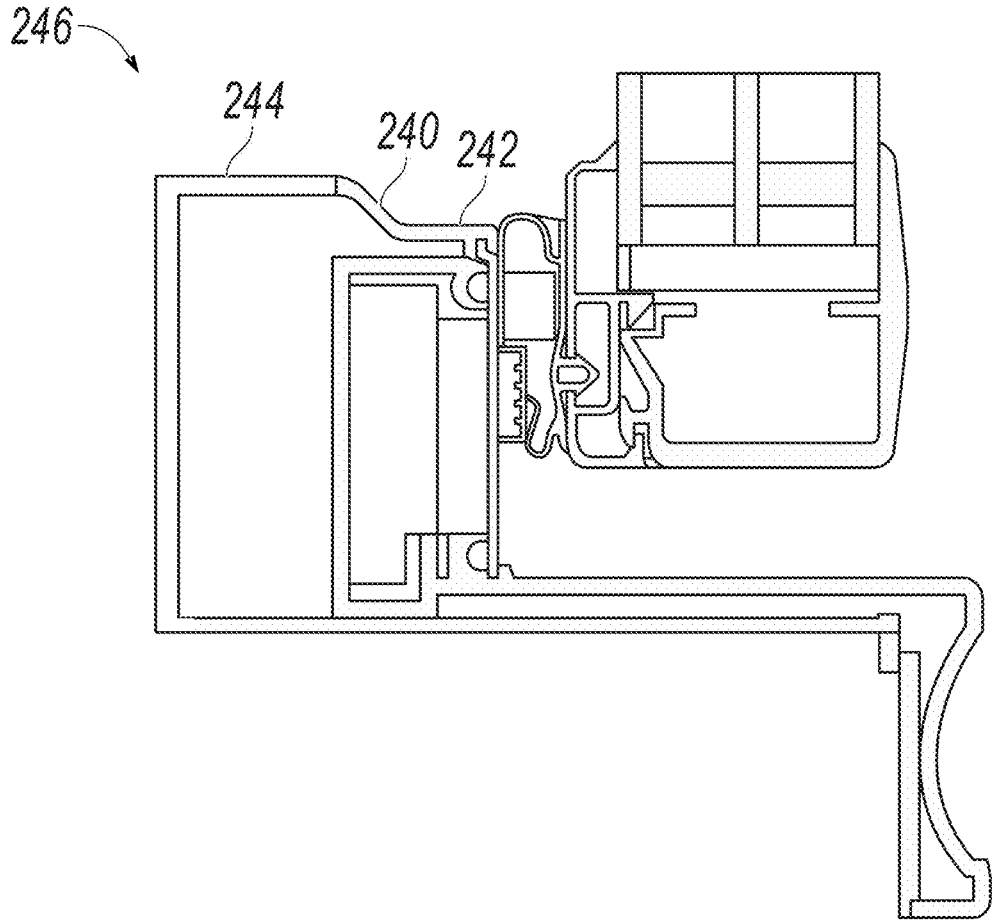
FIG. 13 depicts an example of a backing member including a step.

In some implementations, an interior surface of a backing member varies in thickness over the length of the interior leg. FIG. 13 depicts an example of a backing member including a step. Step 240 is included between interior surface 242 and interior surface 244 of backing member 246.

Inhibiting transfer of heat to the cold interior space at the interface of a door and frame may help maintain the temperature of the sealing surface of a contact plate above the dew point of the external environment. This inhibits condensation from forming on the sealing surface of the contact plate. Prevention of condensation on the sealing surface may promote positive engagement and improved thermal seals between contact plates and door gaskets.

Figure 14:
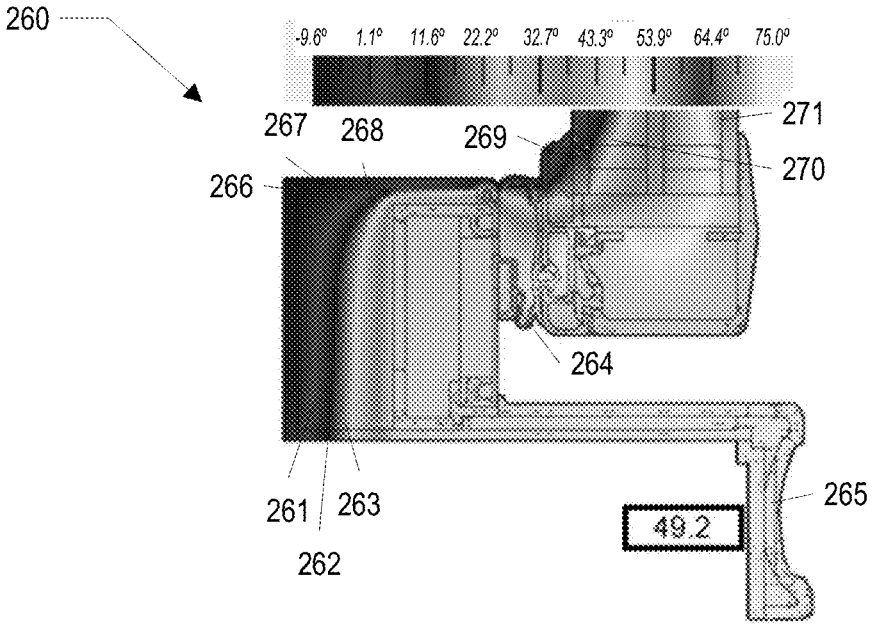
FIG. 14 shows a thermal map of results from thermal modeling performed on a door and frame segment assembly shown in FIG. 11.

FIG. 14 shows a thermal map 260 of results from thermal modeling performed on the door and frame segment assembly of FIG. 11. As illustrated by the temperature regions extending along the outer member and to the contact plate, the thermally conductive outer member of the frame assembly readily conducts heat from the external environment to the thermal plate. Thus, main frame member 202 and contact plate 44 may be maintained at a relatively uniform temperature with the external environment. On the interior side of the frame segment, there is a relatively steep temperature gradient, as indicated by the rapid transition of temperature regions in a short distance from the interior surface of the hacking member. This steep temperature gradient indicates that the backing member is preventing heat from the external environment from entering into the inside of the refrigerated enclosure. For illustrative purposes, the following are approximate temperatures at locations 261 through 271 shown in FIG. 14: 261: 1.0° F., 262: 11.6° F., 263: 22.2° F., 264: 48.6° F., 265: 49.2° F., 266: −9.7° F., 267: 1.0° F., 268: 22.2° F., 269: 1.0° F., 270: 22.2° F., 271: 53.9° F.

Figure 15:
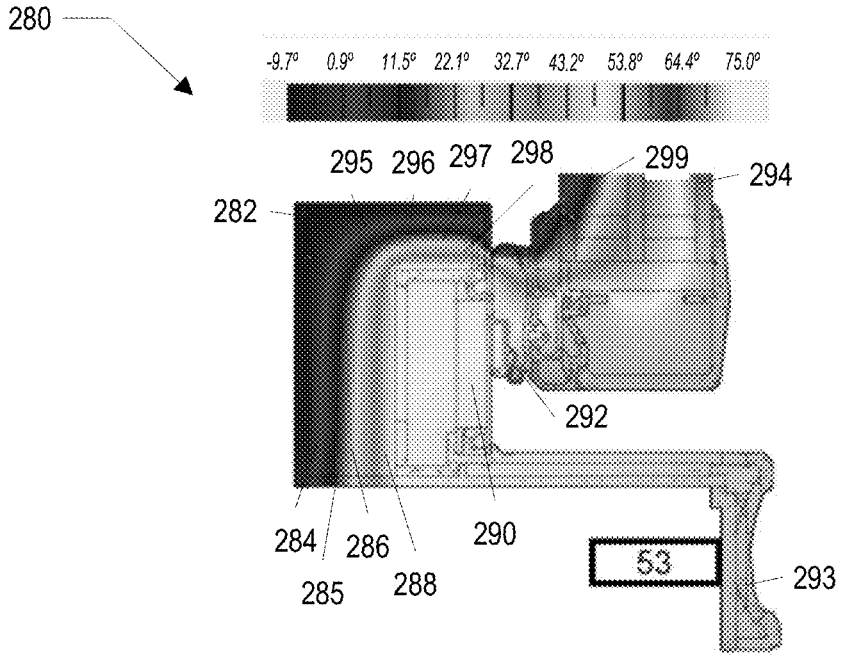
FIG. 15 shows a thermal map of results from thermal modeling performed on a door and frame segment assembly shown in FIG. 12.

FIG. 15 shows a thermal map 280 of results from thermal modeling performed on the door and frame segment assembly of FIG. 12. Similar to the thermal map 260, the steep temperature gradient on the interior side of the frame segment indicates that the backing member is preventing heat from the external environment from entering into the inside of the refrigerated enclosure. For illustrative purposes, the following are approximate temperatures at locations 282 through 299 shown in FIG. 15: 282: −9.7° F., 284: 0.9° F., 285: 1.5° F., 286: 22.1° F., 288: 43.2° F., 290: 48.5° F., 292: 53.8° F., 293: 53° F., 294: 59.1° F., 295: 0.9° F., 296: 11.5° F., 297: 22.1° F., 298: 32.7° F., 299: 22.1° F.

In certain implementations, a frame includes an elongated edge on the front portion of the frame to increase heat absorption to keep temperature of the frame high enough to avoid. condensation. In one implementation, the width of the forward flange of the main frame member is selected to increase heat absorption from the ambient warm air into the frame to inhibit condensation on the frame. An insulating strip may be included behind the forward flange (between the forward flange and the enclosure in which the frame is installed).

In some implementations, a temperature-controlled enclosure has a forward flange with physical characteristics that control thermal characteristics of a frame/door interface. For example, an outer edge of the door can be kept above the dew point of ambient air.

Referring again to FIG. 7, main frame member 100 includes forward flange 108. Forward flange 108 includes a front surface in contact with the ambient air outside of refrigerated enclosure 10. Main frame member 100 can be made of a thermally conductive material, such as aluminum. Forward flange 108 can absorb heat from the ambient air. A portion of the heat absorbed from the ambient air can be conducted through main frame member 100 (including middle wall 106 and base 102) and transferred to contact plate 44.

In some implementations, a length of a forward flange is selected to maintain temperatures in one or more locations of frame segment assembly 60, door 36, or both, in a target temperature range. As used herein, a "target" of a characteristic can be for a specific value or a range of values. A "target range" can have upper and lower bounds, or can be unlimited in one direction. For example, as one example, one target temperature range for a location on a contact plate can be 45 to 60 degrees F. Another target temperature range for a location on a contact plate can be 50 degrees F. and above.

In one implementation, a length L of forward flange 108 (measured from the top to bottom in FIG. 7) is about 1.5 inches or more. In one implementation, the length of a forward flange is about 1.6 inches. In another implementation, the length of a forward flange is about 1.0 inches or more in another implementation, the length of a forward flange is about 1.25 inches or more.

Figure 16:
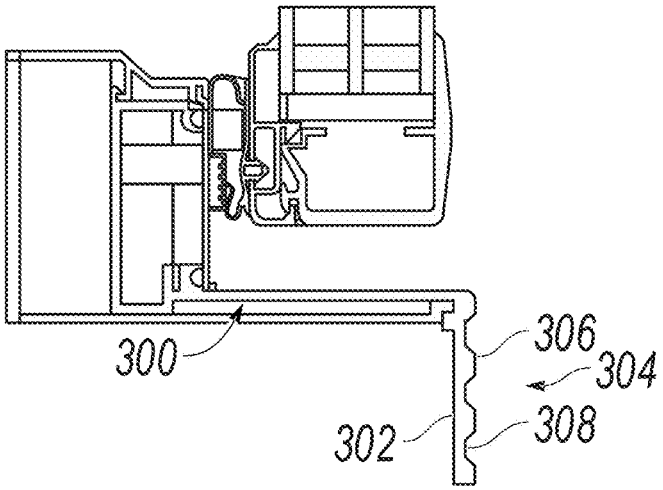
FIG. 16 illustrates a thermal frame having a forward ball flange according to implementations of the present disclosure.

In some implementations, a surface area of a forward flange is selected to increase absorption of heat from ambient air. The front surface of forward flange can include, an arcuate shaped, ridges, grooves, bumps, or other members that increase a surface area in comparison to a flat surface. FIG. 16 illustrates a thermal frame having a forward ball flange. Frame segment member 300 includes ball flange 302. Ball flange 302 includes front surface 304. Front surface 304 of ball flange 302 includes rounded ridges 306 and corresponding grooves 308. The undulations of front surface 304 result in a larger surface area of front surface 304. In one implementation, the front surface area of a forward flange is about 1.5 inches or more per linear inch of frame segment. In another implementation, the front surface area of a forward flange is about 1.0 inches or more per linear inch of frame segment. In another implementation, the front surface area of a forward flange is about 1.25 inches or more per linear inch of frame segment.

Figure 17:
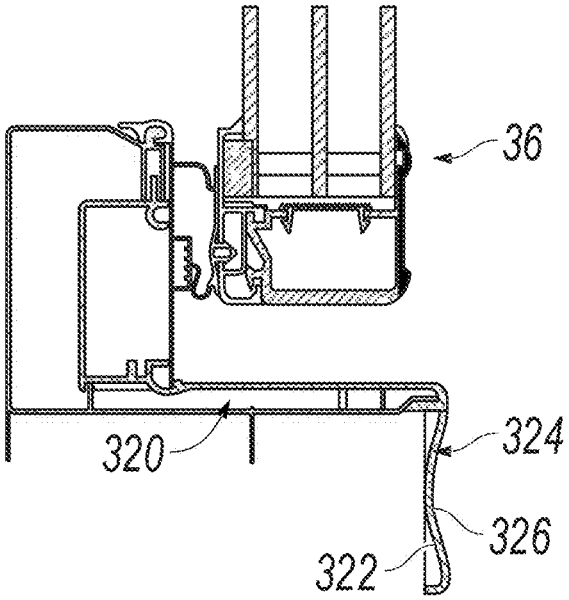
FIG. 17 illustrates a thermal frame having a forward flange with a curved surface according to implementations of the present disclosure.

FIG. 17 illustrates a thermal frame having a forward flange with a curved surface. Frame segment member 320 includes forward flange 322. Forward flange 322 includes front surface 324. Front surface 324 of forward flange 322 includes convex surface 326. The convex surface 326 results in a larger surface area of front surface 324.

Figure 18:
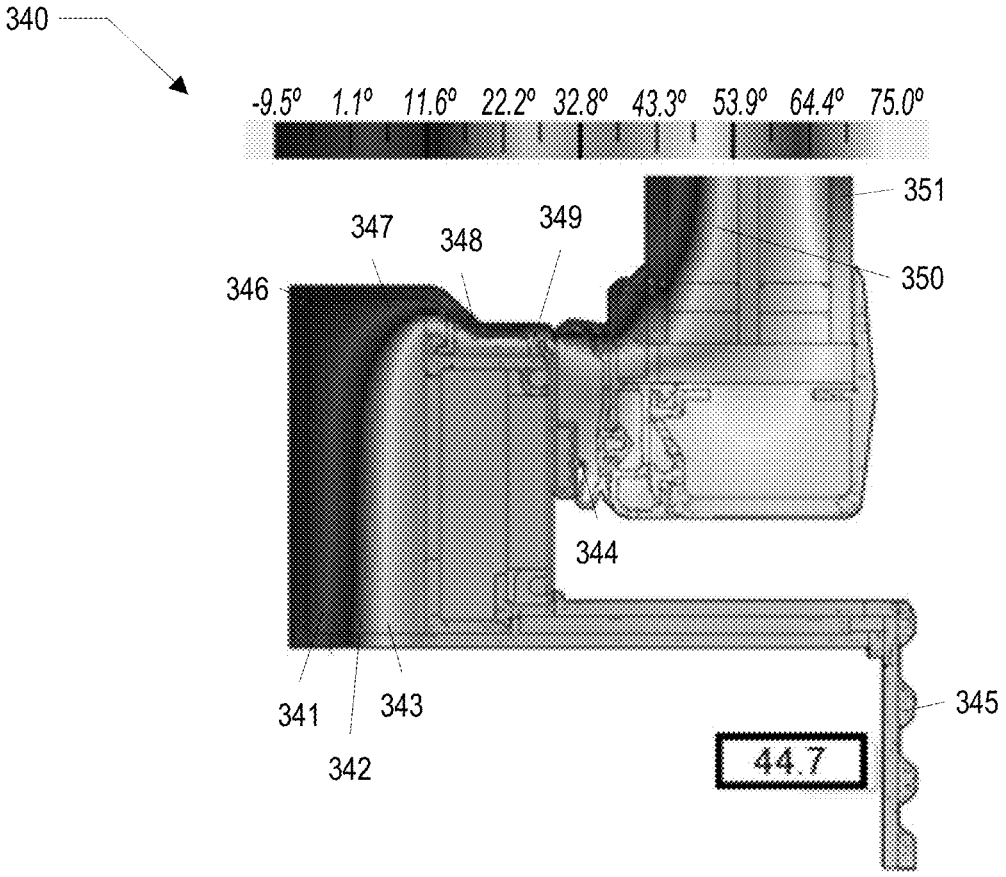
FIG. 18 shows a thermal map of results from thermal modeling performed on the door and frame segment assembly of FIG. 16.

FIG. 18 shows a thermal map 340 of results from thermal modeling performed on the door and frame segment assembly of FIG. 16. As illustrated by the temperature regions extending along the outer member and to the contact plate, the thermally conductive forward flange of the frame assembly conducts heat from the external environment to the contact plate. Thus, the front portion of main frame member, the contact plate, and/or door can be maintained at or above a target temperatures in a manner such as described above. For illustrative purposes, the following are approximate temperatures at locations 341 through 351 shown in FIG. 14: 341: 1.1° F., 342: 11.6° F., 343: 27.5° F., 344: 48.7° F., 345: 44.7° F., 346: −9.5° F., 347: 1.1° F., 348: 11.6° F., 349: 27.5° F., 350: 64.4° F., 351: 27.5° F.

In various implementations described above, heat is absorbed from the ambient air in front of a refrigerated enclosure into a forward flange. In other implementations, thermally conductive segments or members of various shapes and forms can extend from, or be attached to, a thermal frame member to absorb heat from the ambient air in front of a refrigerated enclosure. For example, a U-channel or angle can be attached to forward flange 108. In some implementations, a front flange can include ribs, fins, corrugations or other features on the front of the flange.

In some implementations, condensation on a refrigerated enclosure is controlled by selecting one or more target thermal characteristics at one or more locations of a door/frame interface of a refrigerated enclosure. The method can include providing a thermal frame with a forward flange having one or more physical characteristics that maintain the at least one of the target characteristics. For example, the length of the forward flange can be selected to maintain a temperature at an outer edge of a door at or above a target temperature. In one implementation, the length of a forward flange is large enough to maintain an outer edge of a gasket for a door a.t or above a temperature at which condensation would occur.

In various implementations described above, a target thermal characteristic is a temperature or a temperature range. In some implementations, other thermal characteristics can be used. Examples of other thermal characteristics that can be used include a rate of temperature change, an amount of heat transfer, or a rate of heat transfer.

In certain implementations, a refrigerated enclosure includes a mullion having thickened sidewalls that reduce thermal transference from front to back of the mullion. Thermally insulating material (e.g., foam board) can be placed on the mullion sides. The mullion can include co-extruded portions, one of the co-extruded portions being of a lower density than the other co-extruded portion. The lower density material for the mullion may be, for example, a cellular material or ABS foam. The lower-density co-extruded portion is on the contact-plate side of the mullion. The lower-density co-extruded portion can receive a heater wire and zipper and serves as a thermal break.

In certain implementations, a refrigerated enclosure includes a mullion bracket that serves as a thermal barrier between the mullion and a frame segment to which the mullion connected. The mullion includes a perimeter flange between the mullion and the frame. The bracket can restrict air from passing between the door frame and the mullion. A rectangular block of the mullion bracket can be inserted into a corresponding opening in the mullion. The block of the mullion bracket can be secured to the mullion by way of opposing fasteners in the lateral walls of the mullion.

In certain implementations, frame members, mullion members, or both, of a refrigerated enclosure have heater wire grooves that position a heater wire in direct contact with contact plate of the frame.

In various implementations described above, a bracket for a backing member includes a portion that is used to attach a main frame member to the body of an enclosure. In other implementations, a bracket for a backing member is separate from a bracket that is used to mount the main frame member to a body of an enclosure. In some implementations, a backing member may not include a bracket at all.

As used herein, "control" of a characteristic includes influencing or affecting a value of the characteristic. For example, an insulating member can be selected to control a temperature of a location on a frame member such that the temperature of a surface of a frame is maintained at a higher level.

As used herein, a "main" frame member includes any frame member to which other components of a frame assembly can be attached. For example, main frame member 100 provides a base to which contact plate 44 and backing member 102 can be coupled.

As used herein, a "member" can he a unitary structure or a combination of two or more members or components.

As used herein, "coupled" includes directly or indirectly connected. Two elements are coupled if they contact one another (e.g., where faces of a backing member and a contact plate are in contact with one another.)

As used herein, the terms "perpendicular," "substantially perpendicular," or "approximately perpendicular" refer to an orientation of two elements (e.g., lines, axes, planes, surfaces, walls, or components) with respect to one and other that forms a ninety degree (perpendicular) angle within acceptable engineering, machining, or measurement tolerances. For example, two surfaces can he considered orthogonal to each other if the angle between the surfaces is within an acceptable tolerance of ninety degrees (e.g., ±1-5 degrees).

It should be noted that the orientation of various elements may differ according to other exemplary embodiments, and that such variations are intended to be encompassed by the present disclosure.

While a number of examples have been described for illustration purposes, the foregoing description is not intended to limit the scope of the invention, which is defined by the scope of the appended claims. There are and will be other examples and modifications within the scope of the following claims. For example, the construction and arrangement of the refrigerated case with thermal door frame as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the description and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. Other substitutions, modifications, changes and omissions may be made in the design, operating conditions and arrangement of the various exemplary embodiments without departing from the scope of the present inventions.

What is claimed is:

1. A temperature-controlled enclosure for displaying cold items, comprising:

a body comprising a front opening and defining an interior space of the temperature- controlled enclosure;

a contact plate;

a frame assembly coupled in the front opening of the body and supporting the contact plate, wherein the frame assembly comprises a frame segment comprising, in cross-section:

a main frame member comprising:

a base;

a middle wall; and a forward flange extending away from the middle wall and having a front surface exposed to ambient air, the forward flange comprising a central region defined between a raised corner and an outer edge of the forward flange, wherein, within the central region, the front surface is non-planar, thereby, providing a heat transfer surface with more surface area in contact with the ambient air than a planar surface, whereby, heat from the ambient air is conducted through the main frame member to the contact plate; and one or more doors coupled to the frame assembly, wherein at least one of the doors comprises:

one or more window panels; and a gasket coupled on a rear surface of the door, wherein the gasket is configured to form a seal between the frame assembly and the door when the door is closed, wherein the central region of the forward flange comprises two or more ridges between the raised corner and the outer edge, each ridge comprising a planar top surface.

2. The temperature-controlled enclosure of claim 1, wherein a length of the forward flange is configured to inhibit condensation at one more locations on the contact plate.

3. The temperature-controlled enclosure of claim 1, wherein the heat transfer surface maintains a temperature at one or more locations of the frame assembly above a dew point of the ambient air.

4. The temperature-controlled enclosure of claim 1, wherein the heat transfer surface maintains a temperature at one or more locations on the contact plate at or above a selected temperature.

5. The temperature-controlled enclosure of claim 1, wherein the heat transfer surface inhibits condensation at one more locations on the frame assembly or the one or more doors.

6. The temperature-controlled enclosure of claim 1, wherein the frame segment further comprises:

a backing member coupled to the main frame member, the backing member comprising:

a rear leg that couples on a rear wall of the base of the main frame member; and an interior leg that couples on an interior wall of the base of the main frame member, wherein the interior leg and the rear leg each comprise a thermal insulating portion; and wherein the contact plate is coupled to the main frame member.

7. The temperature-controlled enclosure of claim 1, further comprising an insulating member between the forward flange and the body.

8. A frame for a refrigerated enclosure, comprising:

a frame segment comprising, in cross-section:

a main frame member comprising:

a base;

a middle wall; and a forward flange, the forward flange having a length of at least about 1.5 inches that defines a portion of a heat transfer surface that controls one or more thermal characteristics at one or more locations on the frame segment by absorbing heat from ambient air, the forward flange extending away from the middle wall and having the heat transfer surface exposed to ambient air, the forward flange comprising a central region defined between a raised corner and an outer edge of the forward flange, wherein, within the central region, the heat transfer surface is non-planar, thereby, providing the heat transfer surface with more surface area in contact with the ambient air than a planar surface, whereby, heat from the ambient air is conducted through the main frame member to a contact plate at an increased rate relative to the planar surface, the contact plate configured to receive a door, wherein the central region comprises two or more ridges, each ridge comprising a planar top surface, wherein the heat transfer surface of the forward flange of the main frame member is configured to absorb heat from the ambient air to increase a temperature of the one or more locations of the frame segment.

9. The frame of claim 8, wherein the heat transfer surface comprises a curved front surface.

10. The frame of claim 9, wherein a portion of the curved front surface is concave.

11. The frame of claim 8, wherein the forward flange comprises a rear surface having two or more grooves or ridges.

12. The frame of claim 8, wherein the length of the forward flange is about 1.6 inches.

13. The frame of claim 8, wherein the forward flange of the main frame member is configured to, during use, absorb heat from ambient air to maintain the one or more thermal characteristics at one more locations of the frame segment in a target range.

14. The frame of claim 8, wherein the frame segment further comprises:

a backing member coupled to the main frame member, the backing member comprising:

a rear leg that couples on a rear wall of the base of the main frame member; and an interior leg that couples on an interior wall of the base of the main frame member, wherein the interior leg and the rear leg each comprise a thermal insulating portion; and the contact plate coupled to the main frame member.

15. The frame of claim 14, wherein the interior leg further comprises a front portion configured to couple with the contact plate.

16. A frame for a refrigerated enclosure, comprising:

a frame segment comprising, in cross-section:

a main frame member comprising:

a base;

a middle wall; and a forward flange, the forward flange having a heat transfer surface that controls one or more thermal characteristics at one or more locations on the frame segment by absorbing heat from ambient air, the forward flange extending away from the middle wall and having the heat transfer surface exposed to ambient air, the heat transfer surface comprising a central region defined between a raised corner and an outer edge of the forward flange, and a non-planar surface, the non-planar surface comprising:

a plurality of flat surfaces; and a plurality of ridges comprising a planar top surface, the plurality of ridges interspersed between the plurality of flat surfaces and extending outward from the plurality of flat surfaces, thereby, providing the heat transfer surface with more surface area in contact with the ambient air than a planar surface, whereby, heat from the ambient air is conducted through the main frame member to a contact plate at an increased rate relative to the planar surface, the contact plate configured to receive a door.

* * * * *